US008992195B2

(12) United States Patent
Hossain et al.

(10) Patent No.: US 8,992,195 B2
(45) Date of Patent: Mar. 31, 2015

(54) SCREW COMPRESSOR INCLUDING A SINGLE SCREW ROTOR WITH FIRST AND SECOND SCREW GROOVE BEING BILATERALLY SYMMETRIC

(75) Inventors: Mohammod Anwar Hossain, Sakai (JP); Masanori Masuda, Sakai (JP); Kaname Ohtsuka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 961 days.

(21) Appl. No.: 12/808,723

(22) PCT Filed: Dec. 16, 2008

(86) PCT No.: PCT/JP2008/072808

§ 371 (c)(1),
(2), (4) Date: Jun. 17, 2010

(87) PCT Pub. No.: WO2009/081788

PCT Pub. Date: Jul. 2, 2009

(65) Prior Publication Data

US 2010/0260639 A1 Oct. 14, 2010

(30) Foreign Application Priority Data

Dec. 20, 2007 (JP) ..... 2007-329094

(51) Int. Cl.
*F04C 18/52* (2006.01)
*F01C 17/02* (2006.01)
(Continued)

(52) U.S. Cl.
CPC ..... *F04C 18/52* (2013.01); *F01C 17/02* (2013.01); *F04C 23/001* (2013.01);
(Continued)

(58) Field of Classification Search
CPC ..... F01C 17/02; F04C 18/16; F04C 18/52; F04C 2240/52; F04C 2240/603; F04C 23/001; F04C 27/004; F04C 27/007; F04C 29/124
USPC ..... 418/195–200, 201.1, 203, 205, 1, 15
See application file for complete search history.

(56) References Cited

U.S. PATENT DOCUMENTS 30,400 A * 10/1860 Zimmern ..... 285/345
1,735,477 A * 11/1929 Stuart ..... 418/195
(Continued)

FOREIGN PATENT DOCUMENTS

JP 60-187785 A 9/1985
JP 60-249689 A 12/1985
(Continued)

OTHER PUBLICATIONS

Definitions of 'Backflow' and 'Bilateral Symmetry' as found in the American Heritage Dictionary of English Language located on the Internet.*
(Continued)

*Primary Examiner* — Mary A Davis
*Assistant Examiner* — Paul Thiede
(74) *Attorney, Agent, or Firm* — Global IP Counselors

(57) ABSTRACT

A screw compressor includes a rotatable screw rotor and a plurality of gate rotors. The screw rotor has helical grooves formed in an outer circumferential surface of the screw rotor. The gate rotors have a plurality of radially disposed teeth meshing with the grooves of the screw rotor. The helical grooves include a first screw groove and a second screw groove. The first screw groove compresses a fluid from one end side of the screw rotor to an other end side of the screw rotor. The second screw groove compresses the fluid from the other end side of the screw rotor to the one end side of the screw rotor.

11 Claims, 5 Drawing Sheets

(51) Int. Cl.

| | |
|---|---|
| ***F04C 23/00*** | (2006.01) |
| ***F04C 18/16*** | (2006.01) |
| ***F04C 29/12*** | (2006.01) |
| ***F04C 27/00*** | (2006.01) |

(52) U.S. Cl.

CPC ..... *F04C 27/004* (2013.01); *F04C 18/16* (2013.01); *F04C 27/007* (2013.01); *F04C 29/124* (2013.01); *F04C 2240/52* (2013.01); *F04C 2240/603* (2013.01)

USPC ..... 418/195; 418/201.1

(56) References Cited

U.S. PATENT DOCUMENTS

| | | | | |
|---|---|---|---|---|
| 3,205,874 | A * | 9/1965 | Renshaw | 418/195 |
| 4,036,567 | A * | 7/1977 | Sato | 418/105 |
| 4,261,691 | A * | 4/1981 | Zimmern et al. | 417/440 |
| 6,398,532 | B1 | 6/2002 | Zha et al. | |

FOREIGN PATENT DOCUMENTS

| | | | | |
|---|---|---|---|---|
| JP | 60249689 | A | * | 12/1985 |
| JP | 03-099888 | U | | 10/1991 |
| JP | 08-144972 | A | | 6/1996 |
| JP | 2000-145675 | A | | 5/2000 |
| JP | 2000-257578 | A | | 9/2000 |
| JP | 2000257578 | A | * | 9/2000 |
| JP | 2001-153074 | A | | 6/2001 |
| JP | 2001-182680 | A | | 7/2001 |
| JP | 2003-286986 | A | | 10/2003 |

OTHER PUBLICATIONS

International Preliminary Report of corresponding PCT Application No. PCT/JP2008/072808.

International Search Report of corresponding PCT Application No. PCT/JP2008/072808.

Japanese Office Action of corresponding Japanese Application No. 2007-329094 dated Oct. 6, 2009.

* cited by examiner

SCREW COMPRESSOR INCLUDING A SINGLE SCREW ROTOR WITH FIRST AND SECOND SCREW GROOVE BEING BILATERALLY SYMMETRIC

CROSS REFERENCE TO RELATED APPLICATIONS

This U.S. National stage application claims priority under 35 U.S.C §119 (a) to Japanese Patent Application No. 2007-329094, filed in Japan on Dec. 20, 2007, the entire contents of which are hereby incorporated herein by reference.

TECHNICAL FIELD

The present invention relates to a screw compressor.

BACKGROUND ART

As described in Japanese Unexamined Patent Application Publication Nos. 2000-257578 an 2003-286986 a conventional screw compressor that comprises a screw rotor, which has helical grooves, and a gate rotor, which comprises a plurality of teeth that meshes with the helical grooves, is known.

In such a screw compressor, driving a screw rotor with a motor compresses a compression medium, which is sucked from one end of the screw rotor into a casing, in compression chambers, which are formed by the casing, the grooves of the screw rotor, and the teeth of the gate rotor, and, after the teeth of the gate rotor disengage from the grooves, high pressure gas is discharged from the other end side of the screw rotor.

SUMMARY

Technical Problem

However, in both of the conventional screw compressors recited in the abovementioned Japanese Unexamined Patent Application Publication Nos. 200-257578 and 2003-286986, because sucking occurs from one end side of the screw rotor and discharging from the other end side, the compression medium leaks from, for example, a labyrinth seal, which is a high pressure side seal portion provided in the vicinity of the high pressure side of the screw rotor between the screw rotor and the casing, thereby causing a decline in performance.

In addition, regarding the balance of pressure applied to the screw rotor, a thrust load is continuously applied to the screw rotor in one direction from the low pressure side to the high pressure side, and therefore the structure makes completely eliminating the thrust load difficult.

Furthermore, normally, if the capacity of the screw compressor is increased, then compressor efficiency improves; however, if the capacity exceeds a certain level, then pressure loss, leakage at the seal portion, and the like will occur, all of which reduces compressor efficiency. Accordingly, it is difficult to improve the performance of a large capacity screw compressor because larger capacities cause the compression medium to leak at the seal portion.

An object of the present invention is to provide a screw compressor that can reduce leakage on the high pressure side and reduce the thrust load.

Solution to Problem

A screw compressor according to a first aspect of the present invention comprises a rotatable screw rotor and a plurality of gate rotors. The rotatable screw rotor has helical grooves in its outer circumferential surface. In the gate rotors, a plurality of teeth that meshes with the grooves of the screw rotor is radially disposed. The helical grooves comprise: a first screw groove, which compresses a fluid from one end side of the screw rotor to an other end side; and a second screw groove, which compresses the fluid from the other end side of the screw rotor to the one end side.

Here, the helical grooves of the screw rotor, namely, the two types of screw grooves, comprise the first screw groove, which compresses the fluid from one end side of the screw rotor to the other end side, and the second screw groove, which compresses the fluid from the other end side to the one end side of the screw rotor. Thereby, it is possible to reduce, in the vicinities of thrust bearings at end parts of a conventional screw rotor, the leakage of a refrigerant on a high pressure side; thereby, it is possible to manufacture a compact, high efficiency, large capacity, single screw compressor.

A screw compressor according to a second aspect of the present invention is the screw compressor according to the first aspect of the present invention, wherein the first screw groove and the second screw groove are disposed such that they are arrayed in a rotational axis direction of the screw rotor and are planarly symmetric.

Here, the first screw groove and the second screw groove are disposed such that they are arrayed in the rotational axis direction of the screw rotor and are planarly symmetric; thereby, it is possible to reduce, in the vicinities of the thrust bearings at the end parts of a conventional screw rotor, leakage of the refrigerant on the high pressure side, which makes it possible to manufacture a high efficiency, large capacity, single screw compressor. In addition, it is possible to completely balance the thrust loads that act on the screw rotor in the direction leading from the low pressure side to the high pressure side of the first screw groove and in the direction leading from the low pressure side to the high pressure side of the second screw groove.

A screw compressor according to a third aspect of the present invention is the screw compressor according to the second aspect of the present invention, wherein the plurality of the gate rotors are disposed corresponding to the first screw groove and the second screw groove of the screw rotor such that they are arrayed in the rotational axis direction of the screw rotor and are planarly symmetric.

Here, the plurality of the gate rotors correspond to the first screw groove and the second screw groove of the screw rotor and are disposed such that they are arrayed in the rotational axis direction of the screw rotor and are planarly symmetric to one another; thereby, it is possible to reduce, in the vicinities of the thrust bearings at the end parts of a conventional screw rotor, leakage of the refrigerant gas on the high pressure side, which makes it possible to manufacture a high efficiency, large capacity, single screw compressor. In addition, it is possible to completely balance the thrust loads that act on the screw rotor in a direction leading from the low pressure side to the high pressure side of the first screw groove and in a direction leading from the low pressure side to the high pressure side of the second screw groove.

A screw compressor according to the fourth aspect of the present invention is the screw compressor according to any one aspect of the first through third aspects of the present invention that further comprises an intermediate bearing. The intermediate bearing is disposed between a portion at which the first screw groove of the screw rotor is formed and a portion at which the second screw groove of the screw rotor is formed.

Here, the present aspect further comprises the intermediate bearing disposed between a portion at which the first screw groove is formed in the screw rotor and a portion at which the second screw groove is formed in the screw rotor; therefore, the thrust loads that act on the screw rotor can be received by the single intermediate bearing; moreover, fewer parts are needed in the portion at which the screw rotor is supported.

A screw compressor according a fifth aspect of the present invention is the screw compressor according to any one aspect of the first through third aspects of the present invention that further comprises twin bearings. The twin bearings are disposed on opposite ends of the screw rotor.

Here, the present aspect further comprises the twin bearings that are disposed on opposite ends of the screw rotor, which makes it possible to share the inlet ports or the discharge ports of the intermediate portion of the screw rotor and thereby to develop a compact, high efficiency, large capacity compressor.

A screw compressor according a sixth aspect of the present invention is the screw compressor according to any one aspect of the first through fifth aspects of the present invention that further comprising a casing that houses the screw rotor. The casing comprises inlet ports and discharge ports. The inlet ports are formed in the vicinity of both sides of the screw rotor. The inlet ports suck a compression medium into the casing. The discharge ports are formed in the vicinity of an intermediate point of the portions at which the first screw groove and the second screw groove of the screw rotor are formed. The discharge ports discharge the compression medium compressed inside the casing.

Here, the inlet ports are formed in the vicinity of both sides of the screw rotor, and the discharge ports are formed in the vicinity of the intermediate point of the portions at which the first screw groove and the second screw groove of the screw rotor are formed. Thereby, providing the inlet ports on both sides of the screw rotor makes it possible to cool the motor easily. In the case of an open type compressor, which is a compressor wherein a motor is housed in a space separate from the spaces wherein a screw rotor is housed, providing inlet ports on both sides makes it possible to reduce the leakage of the compressed gas from a seal portion of a shaft.

A screw compressor according to a seventh aspect of the present invention is the screw compressor according to any one aspect of the first through fifth aspects of the present invention that further comprises a casing that houses the screw rotor. The casing comprises discharge ports and inlet ports. The discharge ports are formed in the vicinity of both sides of the screw rotor. The discharge ports discharge a compression medium that was compressed in the casing. The inlet ports are formed in the vicinity of an intermediate point of the portions at which the first screw groove and the second screw groove of the screw rotor are formed. The inlet ports suck the compression medium into the casing.

Here, forming the inlet ports in the vicinity of the intermediate point of the portions at which the first screw groove and the second screw groove of the screw rotor are formed and forming the discharge ports in the vicinity of both sides of the screw rotor makes it possible to reduce losses in inlet pressure and to manufacture a high efficiency, single screw compressor.

A screw compressor according to an eighth aspect of the present invention is the screw compressor according to any one aspect of the first through third, sixth, and seventh aspects of the present invention, wherein the screw rotor is shaped such that it narrows from its intermediate portion to each of its ends.

Here, the screw rotor is shaped such that it narrows from its intermediate portion to each of its ends, which makes it possible to reduce, in the vicinities of the thrust bearings of the end parts of a conventional screw rotor, the leakage of the refrigerant on the high pressure side; thereby, it is possible to manufacture a compact, high efficiency, large capacity, single screw compressor. In addition, it is possible to completely balance the thrust loads that act on the screw rotor in the direction leading from the low pressure side to the high pressure side of the first screw groove and in the direction leading from the low pressure side to the high pressure side of the second screw groove. In particular, in such a planarly symmetric, tapered screw rotor, there is no need to provide notches of, for example, the discharge cutoffs in the discharge portions on the large diameter side in order to offset the thrust loads. Moreover, in the screw compressor, the number of parts as well as the manufacturing cost can be reduced more than is the case for a conventional two-stage compression screw compressor and the like.

Advantageous Effects of Invention

According to the first aspect of the present invention, it is possible to reduce, in the vicinities of thrust bearings at end parts of a conventional screw rotor, the leakage of a refrigerant on a high pressure side; thereby, it is possible to manufacture a compact, high efficiency, large capacity, single screw compressor.

According to the second aspect of the present invention, it is possible to reduce, in the vicinities of the thrust bearings at the end parts of a conventional screw rotor, leakage of the refrigerant on the high pressure side, which makes it possible to manufacture a high efficiency, large capacity, single screw compressor. In addition, it is possible to completely balance the thrust loads that act on the screw rotor in the direction leading from the low pressure side to the high pressure side of the first screw groove and in the direction leading from the low pressure side to the high pressure side of the second screw groove.

According to the third aspect of the present invention, it is possible to reduce, in the vicinities of the thrust bearings at the end parts of a conventional screw rotor, leakage of the refrigerant on the high pressure side, which makes it possible to manufacture a high efficiency, large capacity, single screw compressor. In addition, it is possible to completely balance the thrust loads that act on the screw rotor in a direction leading from the low pressure side to the high pressure side of the first screw groove and in a direction leading from the low pressure side to the high pressure side of the second screw groove.

According to the fourth aspect of the present invention, the thrust loads that act on the screw rotor can be received by the single intermediate bearing; moreover, fewer parts are needed in the portion at which the screw rotor is supported.

According to the fifth aspect of the present invention, it is possible to share the inlet ports or the discharge ports with the intermediate portion of the screw rotor and thereby to develop a compact, high efficiency, large capacity compressor.

According to the sixth aspect of the present invention, providing the inlet ports on both sides of the screw rotor makes it possible to cool the motor easily. In the case of an open type compressor, which is a compressor wherein the motor is housed in the space separate from the spaces wherein the screw rotor is housed, providing the inlet ports on both sides makes it possible to reduce the leakage of the compressed medium from the seal portion of the shaft.

According to the seventh aspect of the present invention, it is possible to reduce losses in inlet pressure and to manufacture a high efficiency, single screw compressor.

According to the eighth aspect of the present invention, it is possible to reduce, in the vicinities of the thrust bearings of the end parts of a conventional screw rotor, the leakage of the refrigerant on the high pressure side; thereby, it is possible to manufacture a compact, high efficiency, large capacity, single screw compressor. In addition, it is possible to completely balance the thrust loads that act on the screw rotor in the direction leading from the low pressure side to the high pressure side of the first screw groove and in the direction leading from the low pressure side to the high pressure side of the second screw groove. In particular, in such a planarly symmetric, tapered screw rotor, there is no need to provide notches of, for example, the discharge cutoffs in the discharge portions on the large diameter side in order to offset the thrust loads. Moreover, in the screw compressor, the number of parts as well as the manufacturing cost can be reduced more than is the case for a conventional two-stage compression screw compressor and the like.

DETAILED DESCRIPTION OF EMBODIMENT(S)

The following text explains embodiments of a screw compressor of the present invention, referencing the drawings.

<First Embodiment>

<Entire Configuration of Single Screw Compressor 1>

Figure 1:
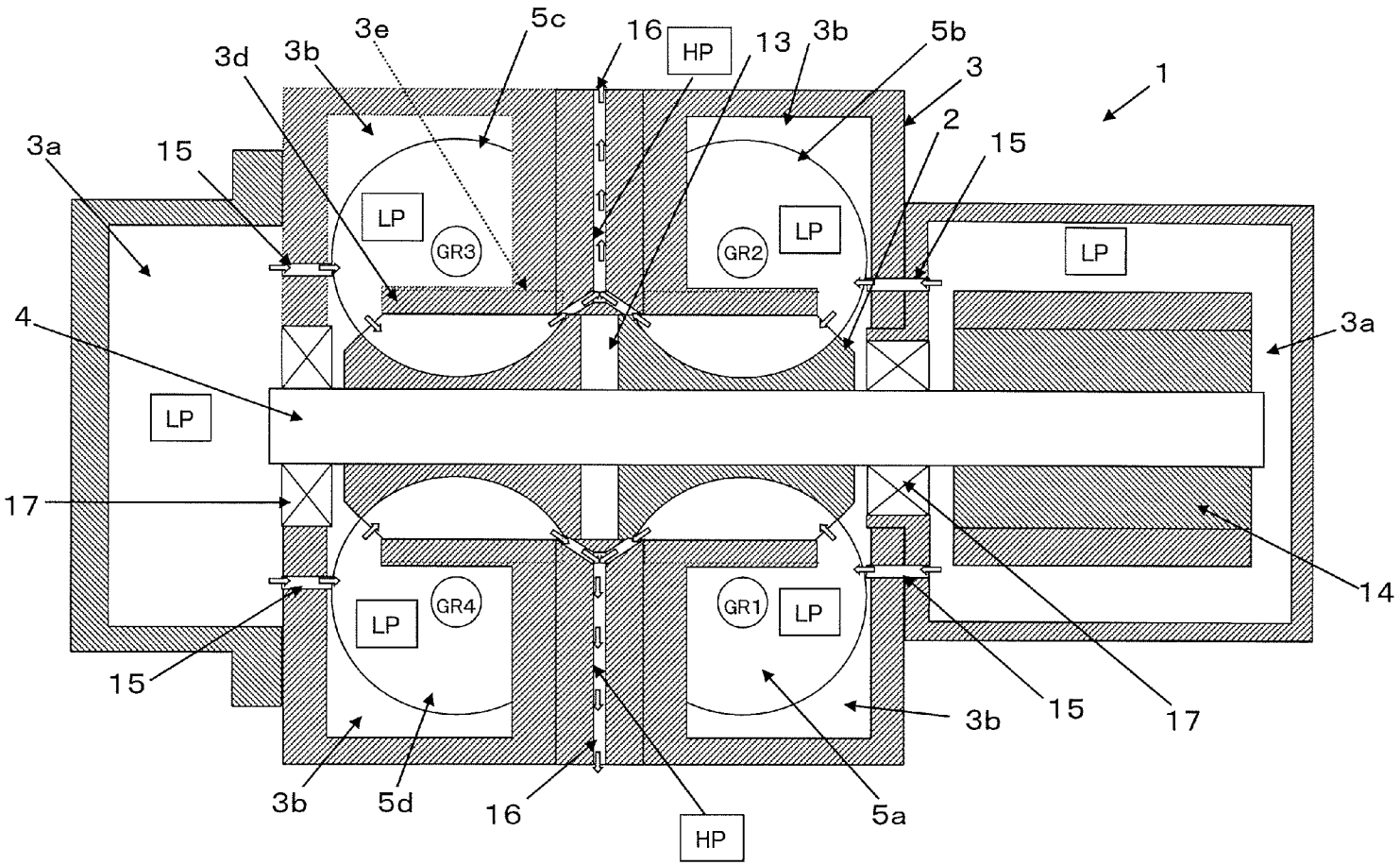
FIG. 1 is a cross sectional view of a single screw compressor according to a first embodiment of the present invention.
Figure 2:
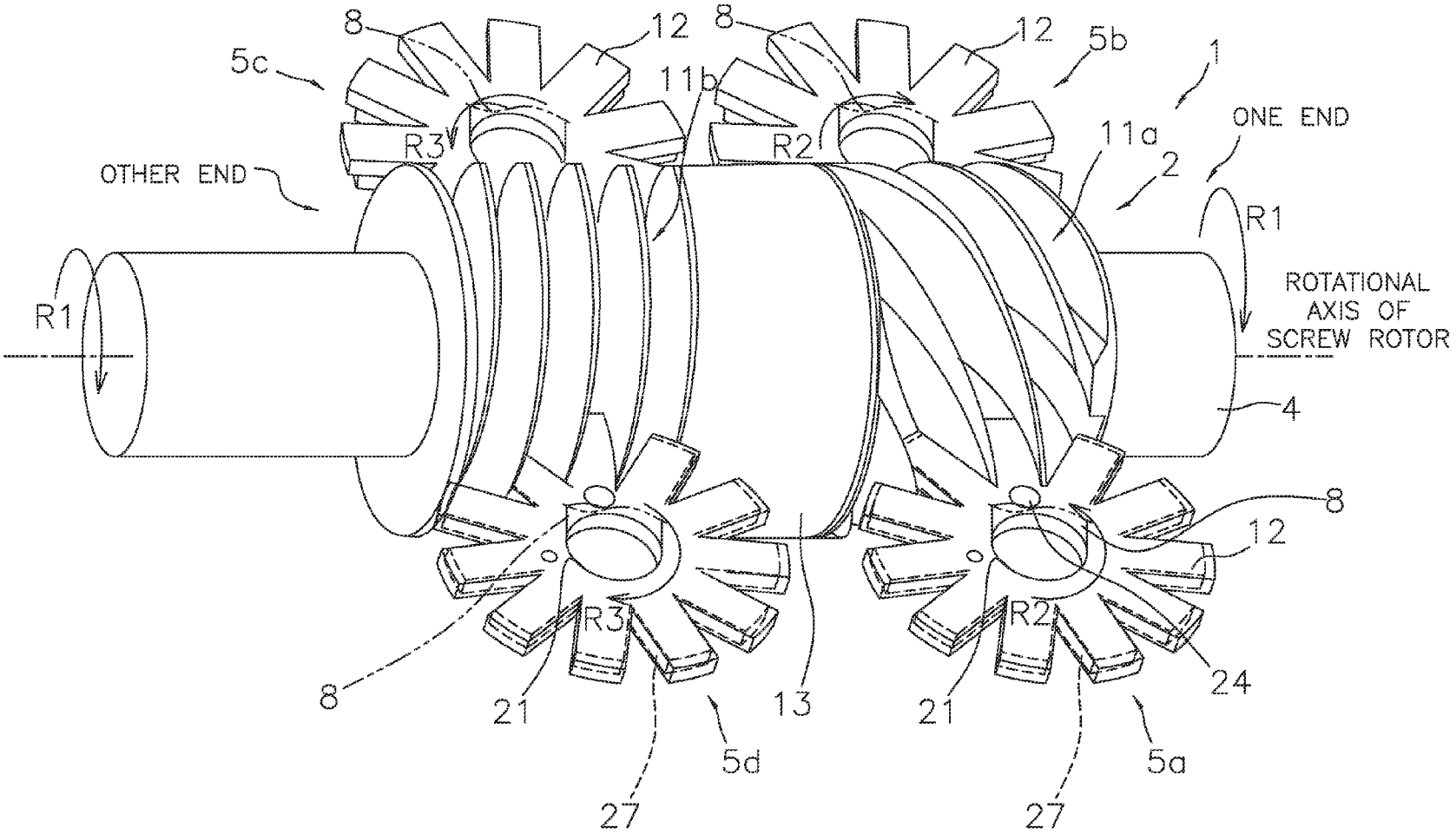
FIG. 2 is an oblique view of the principal portions of the single screw compressor according to the first embodiment of the present invention.
Figure 3:
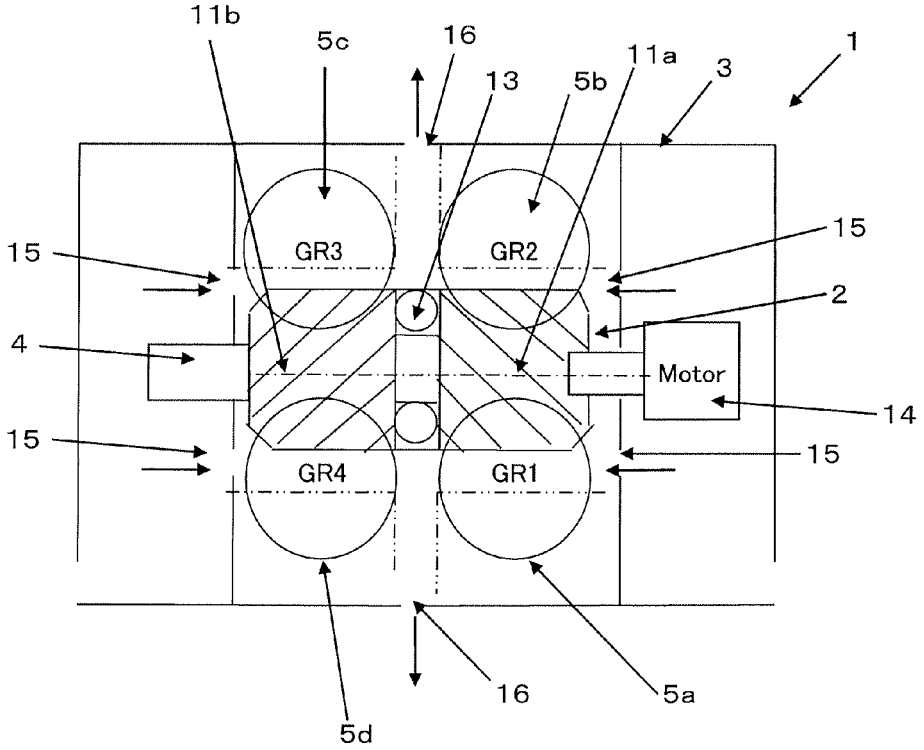
FIG. 3 is a block diagram that shows the arrangement of the screw rotor and the gate rotors of FIG. 1.

A single screw compressor 1 shown in FIGS. 1 through 3, comprises: one screw rotor 2; a casing 3; a shaft 4, whose rotational axis is the screw rotor 2; four gate rotors 5*a*, 5*b*, 5*c*, 5*d;* and an intermediate bearing 13, which supports an intermediate portion of the screw rotor 2. The casing 3 houses, in an airtight state, the screw rotor 2, the shaft 4, the gate rotors 5*a*, 5*b*, 5*c*, 5*d*, and the intermediate bearing 13.

In addition, the screw compressor 1 of the first embodiment further comprises, in addition to the intermediate bearing 13, bearings 17, which support both ends of the shaft 4, as shown in FIG. 1.

<Configuration of Screw Rotor 2>

The screw rotor 2 is a columnar rotor that has helical grooves 11*a*, 11*b* in its outer circumferential surface. The screw rotor 2 can rotate integrally with the shaft 4 inside the casing 3.

The helical grooves 11*a*, 11*b* comprise the first screw groove 11*a*, which compresses a fluid from one end side of the screw rotor 2 (i.e., the right side in FIG. 2 and FIG. 3) to the other end side of the screw rotor 2 (i.e., the left side in FIG. 2 and FIG. 3), and the second screw groove 11*b*, which compresses the fluid from the other end side to the one end side of the screw rotor 2. Thereby, it is possible to reduce, in the vicinities of thrust bearings at end parts of a conventional screw rotor, the leakage of a refrigerant on a high pressure side.

In addition, the first screw groove 11*a* and the second screw groove 11*b* are disposed such that they are arrayed in the rotational axis direction of the screw rotor 2 (i.e., the direction that extend along the shaft 4) and are planarly symmetric. Namely, in FIGS. 2, 3, the first screw groove 11*a* and the second screw groove 11*b* sandwich the intermediate bearing 13 and are bilaterally symmetric. Thereby, it is possible to reduce, in the vicinities of the thrust bearings at the end parts of a conventional screw rotor, the leakage of the refrigerant on the high pressure side, which makes it possible to manufacture a high efficiency, large capacity, single screw compressor. In addition, it is possible to completely balance the thrust loads that act on the screw rotor 2 in a direction leading from the low pressure side to the high pressure side of the first screw groove 11*a* and in a direction leading from the low pressure side to the high pressure side of the second screw groove 11*b* (e.g., in directions that lead from both ends of the screw rotor 2 to the intermediate bearing 13).

The screw rotor 2 is supported by the intermediate bearing 13. The outer circumferential surface of the intermediate bearing 13 mates with an inner wall of a cylindrical portion 3*d* of the casing 3.

The intermediate bearing 13 is disposed between a portion at which the first screw groove 11*a* is formed in the screw rotor 2 and a portion at which the second screw groove 11*b* is formed in the screw rotor 2. Thereby, the thrust loads that act on the screw rotor 2 can be received by the single intermediate bearing 13.

The shaft 4 is coupled to the screw rotor 2, and one end of the shaft 4 is linked to a drive motor 14, which is external to the casing 3. In addition, the shaft 4 is supported on both ends by the bearings 17, which are fixed inside the casing 3.

<Configuration of Gate Rotors 5*a* Through 5*d*>

Each of the four gate rotors 5*a*, 5*b*, 5*c*, 5*d* is a rotary body wherein multiple teeth 12, which mesh with the grooves 11*a*, 11*b* of the screw rotor 2, are radially disposed and is capable of rotating around a gate rotor shaft 8. The gate rotor shaft 8 is rotatably supported by the inner wall of the casing 3. The teeth of the gate rotors 5*a*, 5*b*, 5*c*, 5*d* mesh with the grooves 11*a*, 11*b* of the screw rotor 2 through a slit 3*e*, which is formed in the cylindrical portion 3*d* of the casing 3.

The plurality of the gate rotors 5*a*, 5*b*, 5*c*, 5*d* are disposed such that they are planarly symmetric to one another and arrayed in the rotational axis direction of the screw rotor 2 corresponding to the first screw groove 11*a* and the second screw groove 11*b* of the screw rotor 2.

The gate rotor shafts 8 are inserted in respective openings 21 of the four gate rotors 5*a*, 5*b*, 5*c*, 5*d* and rotatably support the gate rotors 5*a*, 5*b*, 5*c*, 5*d*. Specifically, gate rotor supports 27, which support the gate rotors 5*a*, 5*b*, 5*c*, 5*d*, are coaxially fixed to the gate rotor shafts 8. The shape of the gate rotor supports 27 is substantially similar to, though dimensionally slightly smaller than, that of the gate rotors 5*a*, 5*b*, 5*c*, 5*d*. The gate rotors 5*a*, 5*b*, 5*c*, 5*d* are fixed by pins 24 such that they cannot rotate with respect to the gate rotor supports 27. The gate rotor shafts 8 are orthogonal to the shaft 4 of the screw rotor 2.

The teeth 12 of the gate rotors 5*a*, 5*b*, 5*c*, 5*d* are capable of meshing, through the slit 3*e* formed in the casing 3, with the helical grooves 11 of the screw rotor 2 in the casing 3. The four gate rotors 5*a*, 5*b*, 5*c*, 5*d* are symmetric with respect to the center of rotation of the screw rotor 2, are disposed such that they are arrayed in the rotational axis direction of the screw rotor 2 and are planarly symmetric to one another.

If the screw rotor 2 is rotated, then the teeth 12 of the gate rotors 5*a*, 5*b*, 5*c*, 5*d* can mesh sequentially with the plurality of the grooves 11.

The casing 3 has inlet ports 15 and discharge ports 16. The inlet ports 15 are formed in the vicinity of both sides of the screw rotor 2. The inlet ports 15 suck the compression medium into the casing 3. In the casing 3 shown in FIG. 1, the inlet ports 15 suck the refrigerant, which is temporarily introduced to low pressure (LP) chamber portions 3*a* of the casing 3, to low pressure (LP) low pressure spaces 3*b*, wherein the screw rotor 2 is disposed. The low pressure chamber portions 3*a* introduce refrigerant gas from outside of the casing 3 via an inlet pipe (not shown).

The discharge ports 16, which are on the high pressure (HP) side, are formed in the vicinity of an intermediate point of the portions at which the first screw groove 11*a* and the second screw groove 11*b* of the screw rotor 2 are formed. The discharge ports 16 discharge the compression medium compressed by compression chambers—which are formed and enclosed by the cylindrical portion 3*d* inside the casing 3, the screw grooves 11*a*, 11*b*, and the teeth 12 of the gate rotors 5*a*, 5*b*, 5*c*, 5*d*—to the outside of the casing 3.

Specifically, as shown in FIG. 1, the inlet ports 15, which suck the refrigerant compressed inside the casing 3, are openings—one for each of the gate rotors 5*a*, 5*b*, 5*c*, 5*d*—in the vicinity of both ends of the screw rotor 2 in the casing 3. Moreover, the discharge ports 16, which are for discharging the refrigerant compressed inside the casing 3, are openings—on both the upper and lower sides of the screw rotor 2—in the vicinity of an intermediate point of the screw rotor 2 in the casing 3. Thereby, providing the inlet ports 15 (i.e., inlet ports) on both sides of the screw rotor 2 makes it possible to cool the motor 14 easily. In the case of an open type compressor, which is a compressor wherein the motor 14 is housed in the space 3*a* separate from the low pressure spaces 3*b* wherein the screw rotor 2 is housed, providing the inlet ports 15 (i.e., inlet ports) on both sides makes it possible to reduce the leakage of the refrigerant gas from the seal portion of the shaft 4.

<Explanation of Operation of Single Screw Compressor 1>

The single screw compressor 1 shown in FIGS. 1 through 3 compresses gas as described below.

First, when the shaft 4 receives a rotational driving force from the motor 14 external to the casing 3, the screw rotor 2 rotates in the direction indicated by arrows R1. At this time, the teeth 12 of the gate rotors 5*a*, 5*b*, which mesh with the helical groove 11*a* of the screw rotor 2, are pressed to the inner wall of the helical grooves 11, and thereby the gate rotors 5*a*, 5*b* rotate in the directions of arrows R2. Moreover, the teeth 12 of the gate rotors 5*c*, 5*d*, which mesh with the helical groove 11*b* that is planarly symmetric with the groove 11*a*, are pressed to the inner wall of the helical grooves 11, and thereby the gate rotors 5*c*, 5*d* rotate in the directions of arrows R3.

At this time, the volumes of the compression chambers, which are formed and partitioned by the inner surface of the cylindrical portion 3*d* of the casing 3, the grooves 11*a*, 11*b* of the screw rotor 2, and the teeth 12 of the gate rotors 5*a* through 5*d*, are reduced at each of four locations of the screw rotor 2—above, below, to the left, and to the right.

Taking advantage of the reduction of the volumes of the four compression chambers corresponding to the gate rotors 5*a* through 5*d*, the refrigerant introduced from the chamber portions 3*a* to the low pressure spaces 3*b* via the inlet ports 15 of the casing 3 prior to compression is guided to the compression chambers immediately before the grooves 11 and the teeth 12 mesh with one another, the refrigerant is compressed by the reduction of the volumes of the compression chambers while the grooves 11 and the teeth 12 mesh, and, immediately after the grooves 11 and the teeth 12 unmesh, the compressed refrigerant is discharged to the outside of the casing 3 via the discharge ports 16, which open on both the upper and lower sides of the screw rotor 2.

<Characteristics of the First Embodiment>

(1)

The helical grooves 11*a*, 11*b* comprise the first screw groove 11*a*, which compresses the fluid from the one end side of the screw rotor 2 (i.e., the right side in FIG. 2 and FIG. 3) to the other end side of the screw rotor 2 (i.e., the left side in FIG. 2 and FIG. 3), and the second screw groove 11*b*, which compresses the fluid from the other end side to the one end side of the screw rotor 2. Thereby, it is possible to reduce, in the vicinities of thrust bearings at end parts of the conventional screw rotor 2, the leakage of the refrigerant on the high pressure side (particularly leakage of the refrigerant from the labyrinth seal); thereby, it is possible to manufacture a compact, high efficiency, large capacity, single screw compressor. In addition, it is possible to reduce imbalance of the thrust loads that act on the screw rotor 2 in the direction leading from the low pressure side to the high pressure side of the first screw groove 11*a* and in the direction leading from the low pressure side to the high pressure side of the second screw groove 11*b* (e.g., in the directions that lead from both ends of the screw rotor 2 to the intermediate bearing 13). Moreover, in the screw compressor 1 manufactured in this manner, the number of parts as well as the manufacturing cost can be reduced more than is the case for a conventional two stage screw compressor and the like.

(2)

In addition, in the screw compressor 1 of the first embodiment, the first screw groove 11*a* and the second screw groove 11*b* are disposed such that they are arrayed in the rotational axis direction of the screw rotor 2 (i.e., the direction that extend along the shaft 4) and are planarly symmetric. Namely, in FIGS. 2, 3, the first screw groove 11*a* and the second screw groove 11*b* sandwich the intermediate bearing 13 and are bilaterally symmetric. Thereby, it is possible to reduce, in the vicinities of the thrust bearings at the end parts of a conventional screw rotor, leakage of the refrigerant gas on the high pressure side (particularly leakage of the refrigerant from the labyrinth seal), which makes it possible to manufacture a high efficiency, large capacity, single screw compressor. In addition, it is possible to completely balance the thrust loads that act on the screw rotor 2 in the direction leading from the low pressure side to the high pressure side of the first screw groove 11*a* and in the direction leading from the low pressure side to the high pressure side of the second screw groove 11*b* (e.g., in directions that lead from both ends of the screw rotor 2 to the intermediate bearing 13).

(3)

In the screw compressor 1 of the first embodiment, the plurality of the gate rotors 5*a*, 5*b*, 5*c*, 5*d* correspond to the first screw groove 11*a* and the second screw groove 11*b* of the screw rotor 2 and are disposed such that they are arrayed in the rotational axis direction of the screw rotor 2 and are planarly symmetric to one another.

Thereby, it is possible to reduce, in the vicinities of the thrust bearings at the end parts of a conventional screw rotor, leakage of the refrigerant gas on the high pressure side (particularly leakage of the refrigerant from the labyrinth seal), which makes it possible to manufacture a high efficiency, large capacity, single screw compressor. In addition, it is possible to completely balance the thrust loads that act on the screw rotor 2 in the direction leading from the low pressure side to the high pressure side of the first screw groove 11*a* and in the direction leading from the low pressure side to the high pressure side of the second screw groove 11*b* (e.g., in the directions that lead from both ends of the screw rotor 2 to the intermediate bearing 13).

(4)

The screw compressor 1 of the first embodiment further comprises the intermediate bearing 13 disposed between the portion at which the first screw groove 11*a* is formed in the screw rotor 2 and the portion at which the second screw groove 11*b* is formed in the screw rotor 2. Thereby, the thrust loads that act on the screw rotor 2 can be received by the single intermediate bearing 13; moreover, fewer parts are needed in the portion at which the screw rotor 2 is supported.

(5)

In the screw compressor 1 of the first embodiment, the inlet ports 15 are formed in the vicinity of both sides of the screw rotor 2, and the discharge ports 16 are formed in the vicinity of the intermediate point of the portions at which the first screw groove 11*a* and the second screw groove 11*b* of the screw rotor 2 are formed. Thereby, providing the inlet ports 15 (i.e., inlet ports) on both sides of the screw rotor 2 makes it possible to cool the motor 14 easily. In the case of an open type compressor, which is a compressor wherein the motor 14 is housed in the space 3*a* separate from the low pressure spaces 3*b* wherein the screw rotor 2 is housed, providing the inlet ports 15 (i.e., inlet ports) on both sides makes it possible to reduce the leakage of the refrigerant gas from the seal portion of the shaft 4.

<Modified Example of the First Embodiment>

(A)

In the abovementioned first embodiment, the inlet ports 15 are formed in the vicinity of both sides of the screw rotor 2, and the discharge ports 16 are formed in the vicinity of the intermediate point of the portions at which the first screw groove 11*a* and the second screw groove 11*b* of the screw rotor 2 are formed, but the present invention is not limited thereto; for example, the arrangement of the inlet ports 15 and the discharge ports 16 may be switched.

Figure 4:
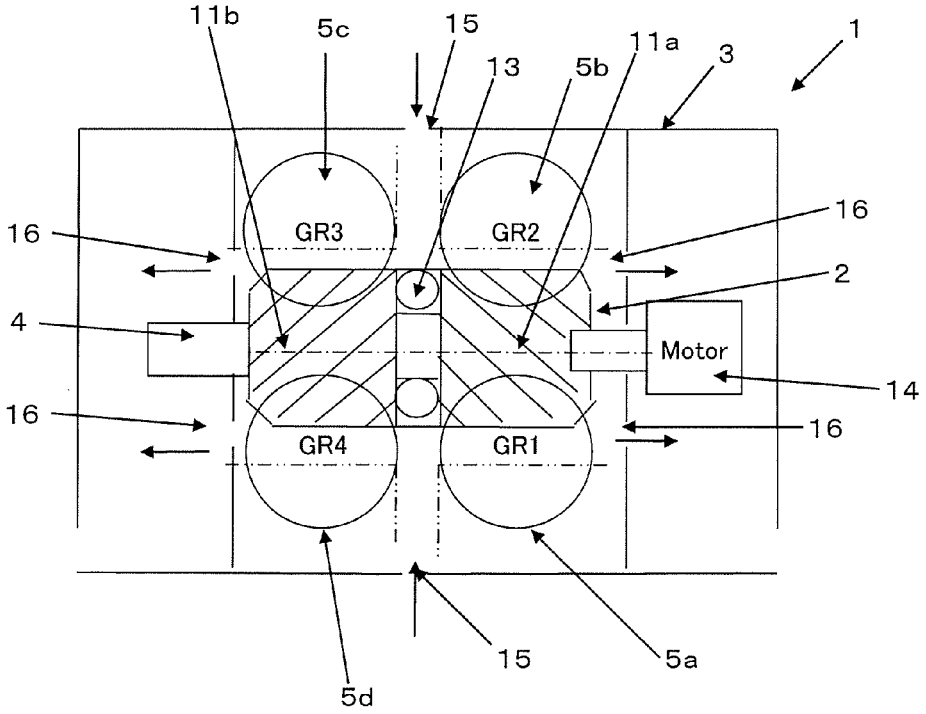
FIG. 4 is a block diagram of a screw compressor, wherein the intake occurs in the vicinity of an intermediate point of the screw rotor and discharge occurs from both sides, that is a modified example of the first embodiment of the present invention.

Namely, in a modified example of the first embodiment of the screw compressor 1, as shown in FIG. 4, the casing 3 has: the discharge ports 16, which are formed in the vicinity of both sides of the screw rotor 2, that discharge the compression medium compressed inside the casing 3; and the inlet ports 15, which are formed in the vicinity of an intermediate point of the portions at which the first screw groove 11*a* and the second screw groove 11*b* of the screw rotor 2 are formed, that suck the compression medium into the casing 3. Other aspects of the configuration are shared with those of the screw compressor 1 shown in FIGS. 1 through 3.

Thus, forming the inlet ports 15 in the vicinity of the intermediate point of the portions at which the first screw groove 11*a* and the second screw groove 11*b* of the screw rotor 2 are formed and forming the discharge ports 16 in the vicinity of both sides of the screw rotor 2 makes it possible to reduce losses in inlet pressure and to manufacture a high efficiency, single screw compressor.

<Second Embodiment>

The abovementioned first embodiment explained an exemplary case wherein the screw compressor comprises the intermediate bearing 13 disposed between the portion at which the first screw groove 11*a* of the screw rotor 2 is formed and the portion at which the second screw groove 11*b* of the screw rotor 2 is formed, but the present invention is not limited thereto.

Figure 5:
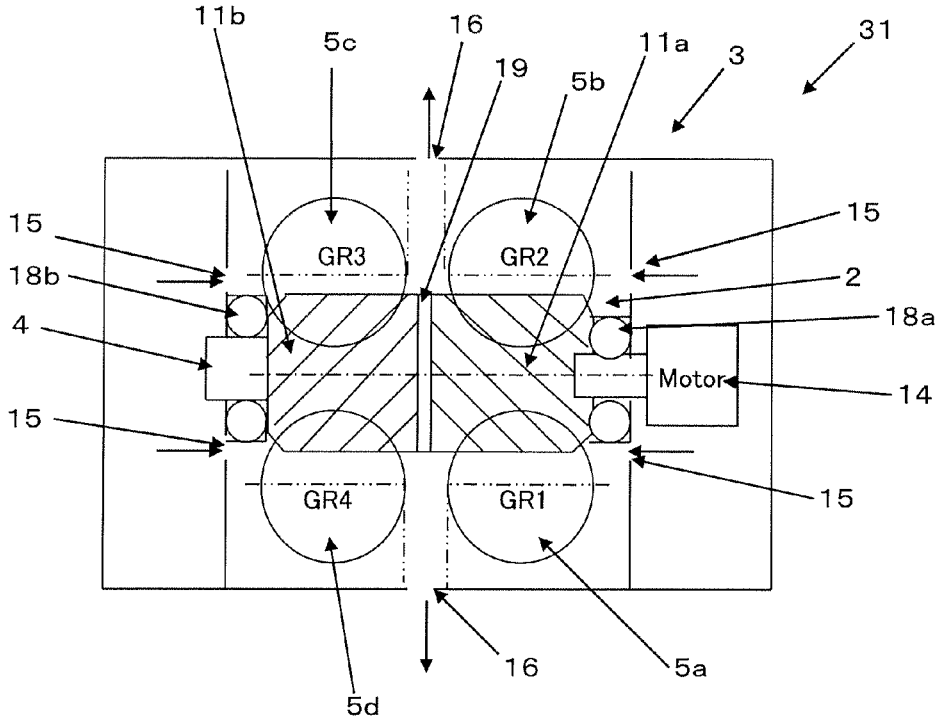
FIG. 5 is a block diagram of the screw compressor, which comprises twin bearings that support both ends of the screw rotor, according to a second embodiment of the present invention.

As shown in FIG. 5, a screw compressor 31 of the second embodiment, rather than comprising the abovementioned intermediate bearing 13, further comprises twin bearings 18*a*, 18*b*, which are disposed on opposite sides of the screw rotor 2. Other aspects of the configuration are shared with those of the screw compressor 1 of the first embodiment. Furthermore, a minor portion 19, wherein grooves are not formed, is formed between the portion at which the first screw groove 11*a* of the screw rotor 2 is formed and the portion at which the second screw groove 11*b* of the screw rotor 2 is formed.

In addition, in the screw compressor 31, the inlet ports 15 are formed in the vicinity of both sides of the screw rotor 2, and the discharge ports 16 are formed in the vicinity of the intermediate point of the portions at which the first screw groove 11*a* and the second screw groove 11*b* of the screw rotor 2 are formed.

<Characteristics of the Second Embodiment>

(1)

The screw compressor 31 of the second embodiment further comprises the twin bearings 18*a*, 18*b*, which are disposed on opposite sides of the screw rotor 2, which makes it possible to share the inlet ports 15 or the discharge ports 16 with the intermediate portion of the screw rotor 2 and thereby to develop a compact, high efficiency, large capacity compressor.

(2)

In addition, in the screw compressor 31 of the second embodiment, as in the first embodiment, the inlet ports 15 are formed in the vicinity of both sides of the screw rotor 2, and the discharge ports 16 are formed in the vicinity of the intermediate point of the portions at which the first screw groove 11*a* and the second screw groove 11*b* of the screw rotor 2 are formed; therefore, providing the inlet ports 15 (i.e., inlet ports) on both sides of the screw rotor 2 makes it possible to cool the motor 14 easily. In the case of an open type compressor, which is a compressor wherein the motor 14 is housed in the space 3*a* separate from the low pressure spaces 3*b* wherein the screw rotor 2 is housed, providing the inlet ports 15 (i.e., inlet ports) on both sides makes it possible to reduce the leakage of the refrigerant gas from the seal portion of the shaft 4.

<Modified Example of the Second Embodiment>

(A)

In the abovementioned second embodiment, the inlet ports 15 are formed in the vicinity of both sides of the screw rotor 2, and the discharge ports 16 are formed in the vicinity of the intermediate point of the portions at which the first screw groove 11*a* and the second screw groove 11*b* of the screw rotor 2 are formed, but the present invention is not limited thereto; for example, as in the first embodiment, the arrangement of the inlet ports 15 and the discharge ports 16 may be switched.

Figure 6:
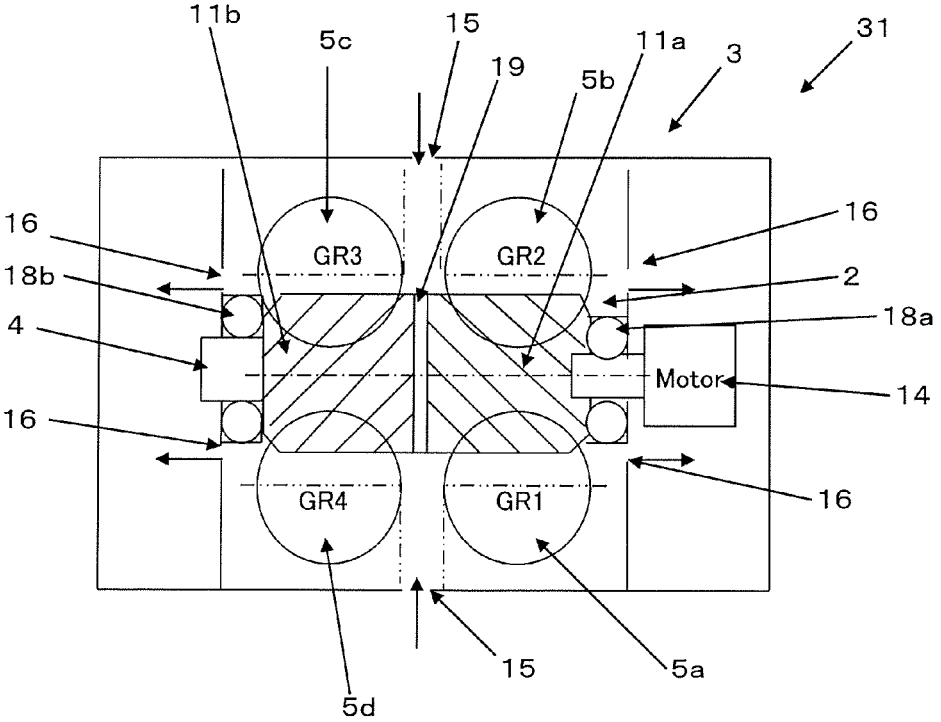
FIG. 6 is a block diagram of the screw compressor, wherein the intake occurs in the vicinity of an intermediate point of the screw rotor and discharge occurs from both sides, that is a modified example of the second embodiment of the present invention.

In this case, too, as shown in FIG. 6, forming the inlet ports 15 in the vicinity of the intermediate point of the portions at which the first screw groove 11*a* and the second screw groove 11*b* of the screw rotor 2 are formed and forming the discharge ports 16 in the vicinity of both sides of the screw rotor 2 makes it possible to reduce losses in inlet pressure and to manufacture a high efficiency, single screw compressor.

<Third Embodiment>

The abovementioned first and second embodiments explained exemplary cases wherein the columnar screw rotor 2 is adopted, but the present invention is not limited thereto; for example, it is possible to use screw rotors of various shapes.

Figure 7:
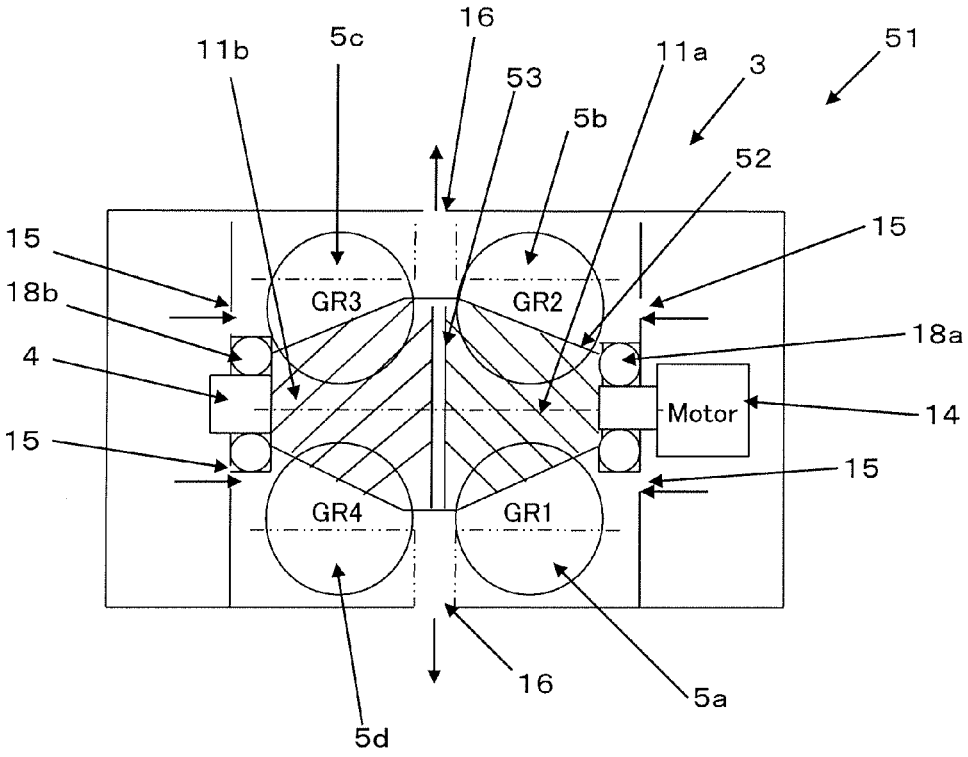
FIG. 7 is a block diagram of a screw compressor according to a third embodiment of the present invention that comprises a screw rotor, both sides of which are tapered and planarly symmetric.

For example, in a screw compressor 51 of the third embodiment shown in FIG. 7, a screw rotor 52 is shaped such that it narrows from its intermediate portion to each of its ends, and constitutes a bilaterally tapered screw rotor that is planarly symmetric.

In addition, in the screw compressor 51, the inlet ports 15 are formed in the vicinity of both sides of the screw rotor 2, and the discharge ports 16 are formed in the vicinity of the intermediate point of the portions at which the first screw groove 11*a* and the second screw groove 11*b* of the screw rotor 2 are formed. Accordingly, the refrigerant is introduced from the low pressure side of both ends of the bilaterally tapered screw rotor 52, which is planarly symmetric, to the first screw groove 11*a* and the second screw groove 11*b*, and high pressure refrigerant is discharged on the high pressure side of the portion of the intermediate portion at which the girth is widest, thereby offsetting the thrust load generated on the first screw groove 11*a* side and the thrust load generated on the second screw groove 11*b* side.

In addition, as shown in FIG. 7, the screw compressor 51 of the third embodiment further comprises, as in the abovementioned second embodiment, the twin bearings 18*a*, 18*b*, which are disposed on opposite ends of the screw rotor 52. Other aspects of the configuration are shared with those of the screw compressor 31 of the second embodiment. In addition, a minor portion 53, wherein grooves are not formed, is formed between the portion at which the first screw groove 11*a* of the screw rotor 52 is formed and the portion at which the second screw groove 11*b* of the screw rotor 52 is formed.

<Characteristics of the Third Embodiment>

(1)

In the screw compressor 51 of the third embodiment, the screw rotor 52 is shaped such that it narrows from its intermediate portion to each of its ends, which makes it possible to reduce, in the vicinities of the thrust bearings of the end parts of a conventional screw rotor, the leakage of the refrigerant on the high pressure side (particularly leakage of the refrigerant from the labyrinth seal); thereby, it is possible to manufacture a compact, high efficiency, large capacity, single screw compressor.

(2)

In addition, it is possible to completely balance the thrust loads that act on the screw rotor 2 in the direction leading from the low pressure side to the high pressure side of the first screw groove 11*a* and in the direction leading from the low pressure side to the high pressure side of the second screw groove 11*b* (e.g., in directions that lead from both ends of the screw rotor 52 to the intermediate bearing 13). In particular, in such a planarly symmetric, tapered screw rotor 52, there is no need to provide notches of, for example, the discharge cutoffs in the discharge portions on the large diameter side in order to offset the thrust loads.

(3)

Moreover, in the screw compressor 51, the number of parts as well as the manufacturing cost can be reduced more than is the case for a conventional two-stage compression screw compressor and the like.

(4)

In addition, in the screw compressor 51 of the third embodiment, as in the first embodiment, the inlet ports 15 are formed in the vicinity of both sides of the screw rotor 52, and the discharge ports 16 are formed in the vicinity of the intermediate point of the portions at which the first screw groove 11*a* and the second screw groove 11*b* of the screw rotor 52 are formed; thereby, providing the inlet ports 15 (i.e., inlet ports) on both sides of the screw rotor 52 makes it possible to cool the motor 14 easily. In the case of an open type compressor, which is a compressor wherein the motor 14 is housed in the space 3*a* separate from the low pressure spaces 3*b* wherein the screw rotor 52 is housed, providing the inlet ports 15 (i.e., inlet ports) on both sides makes it possible to reduce the leakage of the refrigerant gas from the seal portion of the shaft 4.

INDUSTRIAL APPLICABILITY

The present invention can be widely adapted a screw compressor that comprises a screw rotor and gate rotors.

What is claimed is:

1. A screw compressor, comprising:

a single rotatable screw rotor having helical grooves formed in an outer circumferential surface of the single rotatable screw rotor;

a plurality of gate rotors, each of the plurality of gate rotors having a plurality of teeth that are radially disposed in relation to a gate rotor rotation axis of the gate rotor and mesh with the helical grooves of the single rotatable screw rotor; and an intermediate bearing disposed axially between a first screw groove and a second screw groove along the screw rotor rotation axis, the helical grooves including the first screw groove configured and arranged to compress a fluid from one end of the single rotatable screw rotor towards an other end of the single rotatable screw rotor, and the second screw groove configured and arranged to compress the fluid from the other end of the single rotatable screw rotor towards the one end of the single rotatable screw rotor, the first screw groove and the second screw groove being arrayed along a rotational axis direction of the single rotatable screw rotor and being bilaterally symmetric relative to the intermediate bearing.

2. The screw compressor according to claim 1, wherein the plurality of the gate rotors are disposed relative to the first screw groove and the second screw groove of the single rotatable screw rotor such that the plurality of the gate rotors are arrayed along the rotational axis direction of the single rotatable screw rotor.

3. The screw compressor according to claim 2, further comprising:

a casing housing the single rotatable screw rotor, the casing including inlet ports formed in a vicinity of both ends of the single rotatable screw rotor, the inlet ports being configured and arranged to suck a compression medium into the casing, and discharge ports formed in a vicinity of the intermediate bearing, the discharge ports being configured and arranged to discharge the compression medium after being compressed inside the casing.

4. The screw compressor according to claim 2, further comprising:

a casing housing the single rotatable screw rotor, the casing including discharge ports formed in a vicinity of both ends of the single rotatable screw rotor, the discharge ports being configured and arranged to discharge a compression medium that was compressed in the casing; and inlet ports formed in a vicinity of the intermediate bearing, the inlet ports being configured and arranged to suck the compression medium into the casing.

5. The screw compressor according to claim 1, further comprising:

a casing housing the single rotatable screw rotor, the casing including inlet ports formed in a vicinity of both ends of the single rotatable screw rotor, the inlet ports being configured and arranged to suck a compression medium into the casing, and discharge ports formed in a vicinity of the intermediate bearing, the discharge ports being configured and arranged to discharge the compression medium after being compressed inside the casing.

6. The screw compressor according to claim 1, further comprising:

a casing housing the single rotatable screw rotor, the casing including discharge ports formed in a vicinity of both ends of the single rotatable screw rotor, the discharge ports being configured and arranged to discharge a compression medium that was compressed in the casing; and inlet ports formed in a vicinity of the intermediate bearing, the inlet ports being configured and arranged to suck the compression medium into the casing.

7. A screw compressor comprising:

a single rotatable screw rotor having helical grooves formed in an outer circumferential surface of the single rotatable screw rotor;

a plurality of gate rotors each of the plurality of gate rotors having a plurality of teeth that are radially disposed in relation to a gate rotor rotation axis of the gate rotor and mesh with the helical grooves of the single rotatable screw rotor; and a minor portion, in which the helical grooves are not formed, disposed axially between a first screw groove and a second screw groove along the screw rotor rotation axis, the helical grooves including the first screw groove configured and arranged to compress a fluid from one end of the single rotatable screw rotor towards an other end of the single rotatable screw rotor, and the second screw groove configured and arranged to compress the fluid from the other end of the single rotatable screw rotor towards the one end of the single rotatable screw rotor, the first screw groove and the second screw groove being arrayed along a rotational axis direction of the single rotatable screw rotor and being bilaterally symmetric relative to the minor portion.

8. The screw compressor according to claim 7, wherein the single rotatable screw rotor is shaped such that the single rotatable screw rotor narrows as the single rotatable screw rotor extends from the minor portion thereof toward each respective end thereof.

9. The screw compressor according to claim 7, further comprising:

a casing housing the single rotatable screw rotor, the casing including inlet ports formed in a vicinity of both ends of the single rotatable screw rotor, the inlet ports being configured and arranged to suck a compression medium into the casing, and discharge ports formed in a vicinity of the minor portion, the discharge ports being configured and arranged to discharge the compression medium alter being compressed inside the casing.

10. The screw compressor according to claim 7, further comprising:

a casing housing the single rotatable screw rotor, the casing including discharge ports formed in a vicinity of both ends of the single rotatable screw rotor, the discharge ports being configured and arranged to discharge a compression medium that was compressed in the casing; and inlet ports formed in a vicinity of the minor portion, the inlet ports being configured and arranged to suck the compression medium into the casing.

11. The screw compressor according to claim 7, further comprising:

twin bearings disposed at each respective end of the single rotatable screw rotor.

* * * * *